US012357027B2

(12) United States Patent
Qi et al.

(10) Patent No.: US 12,357,027 B2
(45) Date of Patent: Jul. 15, 2025

(54) SMOKING ARTICLE

(71) Applicant: SHENZHEN FIRST UNION TECHNOLOGY CO., LTD., Shenzhen (CN)

(72) Inventors: Zuqiang Qi, Shenzhen (CN); Jian Wu, Shenzhen (CN); Jiamao Luo, Shenzhen (CN); Baoling Lei, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 242 days.

(21) Appl. No.: 17/792,704

(22) PCT Filed: Jan. 13, 2021

(86) PCT No.: PCT/CN2021/071510
§ 371 (c)(1),
(2) Date: Jul. 13, 2022

(87) PCT Pub. No.: WO2021/143726
PCT Pub. Date: Jul. 22, 2021

(65) Prior Publication Data

US 2023/0046414 A1 Feb. 16, 2023

(30) Foreign Application Priority Data

Jan. 13, 2020 (CN) ..... 202010031288.4

(51) Int. Cl.
*A24F 40/46* (2020.01)
*A24F 40/70* (2020.01)

(52) U.S. Cl.
CPC ..... *A24F 40/46* (2020.01); *A24F 40/70* (2020.01)

(58) Field of Classification Search
CPC ..... A24F 40/46; A24F 40/70
See application file for complete search history.

(56) References Cited

U.S. PATENT DOCUMENTS

2018/0153213 A1 6/2018 Heamon

FOREIGN PATENT DOCUMENTS

| | | | | | |
|---|---|---|---|---|---|
| CN | 2206764 | Y | | 9/1995 | |
| CN | 203424290 | U | | 2/2014 | |
| CN | 108095203 | A | | 6/2018 | |
| CN | 108338415 | A | * | 7/2018 | ..... A24F 47/008 |
| CN | 207721209 | U | | 8/2018 | |
| CN | 109077358 | A | | 12/2018 | |
| CN | 109770433 | A | | 5/2019 | |
| CN | 109793265 | A | | 5/2019 | |
| CN | 109793284 | A | | 5/2019 | |
| CN | 109846093 | A | | 6/2019 | |
| CN | 109998174 | A | * | 7/2019 | ..... A24D 1/00 |
| JP | S64-85066 | A | | 3/1989 | |
| JP | H4-58876 | A | | 2/1992 | |
| KR | 10-2006-0056473 | A | | 5/2006 | |

OTHER PUBLICATIONS

CN109998174A English Machine Translation (Year: 2019).*
CN108338415A English Machine Translation (Year: 2018).*

* cited by examiner

*Primary Examiner* — Michael H. Wilson
*Assistant Examiner* — Adam Z Baratz
(74) *Attorney, Agent, or Firm* — Cheng-Ju Chiang

(57) ABSTRACT

A smoking article comprises a smoke generating section, having a tube wall and a tube cavity; the tube cavity being configured to contain the aerosol-forming matrix; an infrared radiation layer, being formed on at least part of the inner surface of the tube wall; the infrared radiation layer being configured to be heated by the smoking set to generate infrared rays and at least heat the aerosol-forming matrix by radiation. The infrared radiation layer is arranged on the inner surface of the tube wall, so that the infrared radiation layer is heated by the smoking set to generate infrared rays and at least heat the aerosol-forming matrix by radiation. The infrared rays have relatively long wavelength, and they can penetrate substance and "resonate" with molecules and atoms inside the substance and produce strong vibration and rotation, so that the temperature of the substance rises to achieve the purpose of heating.

11 Claims, 4 Drawing Sheets

SMOKING ARTICLE

CROSS REFERENCE TO RELATED APPLICATIONS

The present application is a 35 U.S.C. § 371 National Phase conversion of International (PCT) Patent Application No. PCT/CN2021/071510, filed on Jan. 13, 2021, which claims priority to Chinese Patent Application No. 202010031288.4, filed with the Chinese Patent Office on Jan. 13, 2020, titled "SMOKING ARTICLE", the entire contents of which are incorporated herein by reference. The PCT International Patent Application was filed and published in Chinese.

TECHNICAL FIELD

The present application relates to the technical field of tobacco, and in particular, relates to a smoking article.

BACKGROUND

Several aerosol producing articles in which tobacco is heated instead of burned have been proposed in the art. The purpose of such "heating-type" smoking articles is to reduce the known types of harmful smoke components generated by the burning and thermal degradation of tobacco in conventional cigarettes.

In the aerosol producing article in which the aerosol-forming matrix is heated, e.g., in the smoking article in which tobacco is heated, the temperature reached in the aerosol-forming matrix has a significant influence on the ability to produce organoleptically acceptable aerosols. Generally, it is desired to maintain the temperature of the aerosol-forming matrix within a certain range in order to optimize aerosol delivery to users.

The heating modes of currently available smoking articles usually comprise circumferential heating and central heating. In terms of circumferential heating, the heater in the smoking set wraps at least part of the smoking article, and the temperature of the part of the smoking article that is close to the heater is higher, while the temperature of the central part of the smoking article is lower. In terms of central heating, the periphery of the heater in the smoking set is in direct contact with the tobacco in the smoking article, so the temperature of the central part of the smoking article is higher, while the temperature of the peripheral part of the smoking article is lower.

As can be known from the above description, the smoking articles are heated unevenly in both circumferential and central heating modes.

SUMMARY

The present application provides a smoking article, which is intended to solve the phenomenon of uneven heating existing in the currently available smoking articles.

A first aspect of the present application provides a smoking article which is used in combination with a smoking set for heating an aerosol-forming matrix so as to volatilize at least one component of the aerosol-forming matrix, and the smoking article comprises:

- a smoke generating section, having a tube wall and a tube cavity; the tube cavity being configured to contain the aerosol-forming matrix;
- an infrared radiation layer, being formed on at least part of the inner surface of the tube wall; the infrared radiation layer being configured to be heated by the smoking set to generate infrared rays and at least heat the aerosol-forming matrix by radiation.

A second aspect of the present application provides a smoking set suitable for the smoking article described in the first aspect, and the smoking set comprises:

- a housing having an opening through which the smoking article may be at least partially inserted into or removed from the smoking set;
- at least one heating device, being arranged in the housing; the at least one heating device being configured to heat the aerosol-forming matrix of the smoking article during use, so as to volatilize at least one component of the aerosol-forming matrix.

According to smoking article provided by the present application, the infrared radiation layer is arranged on the inner surface of the tube wall, so that the infrared radiation layer is heated by the smoking set to generate infrared rays and at least heat the aerosol-forming matrix by radiation. The infrared rays have relatively long wavelength, and they can penetrate substance and "resonate" with molecules and atoms inside the substance and produce strong vibration and rotation, so that the temperature of the substance rises to achieve the purpose of heating. In this way, the temperature of the substance is increased on the whole, thereby preventing the phenomenon of uneven heating existing in currently available smoking articles, and improving the smoking taste of users.

BRIEF DESCRIPTION OF THE DRAWINGS

One or more embodiments are illustrated by pictures in corresponding attached drawings, and this does not constitute limitation on the embodiments. Elements with the same reference numerals in the attached drawings are shown as similar elements, and the pictures in the attached drawings do not constitute scale limitation unless otherwise stated particularly.

DETAILED DESCRIPTION

In order to facilitate the understanding of the present application, the present application will be explained in more detail below with reference to the attached drawings and the detailed description. It shall be noted that, when an element is expressed as "fixed to" another element, it may be directly on another element, or there may be one or more intervening elements therebetween. When an element is expressed as "connected" to another element, it may be directly connected to another element, or there may be one or more intervening elements therebetween. Terms such as "up", "down", "left", "right", "inside", "outside" and other similar expressions used in this specification are for illustrative purposes only.

Unless otherwise defined, all technical and scientific terms used in this specification have the same meanings as commonly understood by those skilled in the art of the present application. In this specification, the terms used in the specification of the present application are only for the purpose of describing specific embodiments, and are not intended to limit the present application. The term "and/or" used in this specification comprises any and all combinations of one or more related items listed.

Figure 1:
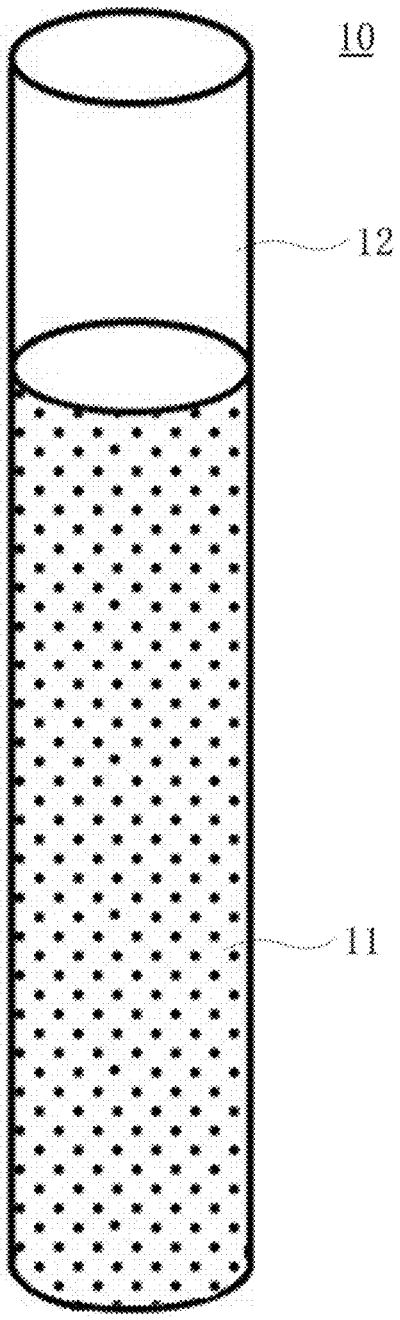
FIG. 1 is a schematic view of a smoking article provided according to an embodiment of the present application.

As shown in FIG. 1, a smoking article 10 provided according to an embodiment of the present application comprises an aerosol-forming matrix, and it is used in combination with a smoking set for heating to volatilize at least one component of the aerosol-forming matrix.

The smoking article 10 comprises a smoke generating section 11 and a filter section 12.

The smoke generating section 11 is filled therein with the aerosol-forming matrix. After the smoke generating section 11 is heated by the smoking set, at least one component of the aerosol-forming matrix may be volatilized to form aerosol.

The aerosol-forming matrix is a matrix which can release volatile compounds capable of forming the aerosol. This kind of volatile compounds can be released by heating the aerosol-forming matrix. The aerosol-forming matrix may be a solid or a liquid or comprise solid and liquid components. The aerosol-forming matrix may be adsorbed, coated, impregnated or otherwise loaded on a carrier or support. The aerosol-forming matrix may conveniently be a part of an aerosol producing article or a smoking article.

The aerosol-forming matrix may comprise nicotine. The aerosol-forming matrix may comprise tobacco, for example, a tobacco-containing material containing a volatile compound with a tobacco flavor, and the volatile compound with the tobacco flavor is released from the aerosol-forming matrix when it is heated. A preferred aerosol-forming matrix may comprise a homogeneous tobacco material, such as deciduous tobacco. The aerosol-forming matrix may comprise at least one aerosol-forming agent, which may be any suitable and known compound or a mixture of compounds. During use, the compound or the mixture of compounds is conducive to the formation of stable aerosol, and is basically resistant to thermal degradation at the operating temperature of the aerosol generating system. Suitable aerosol-forming agents are well known in the art and include but are not limited to: polyols such as triethylene glycol, 1,3-butanediol and glycerol; esters of polyols, such as glyceryl mono-, di- or tri-acetate; and fatty acid esters of mono-, di- or polycarboxylic acids, such as dimethyl dodecanedioate and dimethyl tetradecanedioate. The preferred aerosol-forming agent is polyhydric alcohols or a mixture thereof, such as triethylene glycol, 1,3-butanediol and the most preferred glycerine.

The filter section 12 is configured to filter the at least one volatized component of the aerosol-forming matrix and is received in the mouth of the user.

In an example, the filter section 12 may comprise a filtering section for filtering the at least one volatized component of the aerosol-forming matrix and a mouthpiece end section for being received in the mouth of a user.

It shall be noted that, the smoking article 10 is not limited to the above structure. In an example, a temperature reduction section may be further arranged between the smoke generating section 11 and the filter section 12, and the temperature reduction section may be configured to provide a certain temperature difference between the at least one volatized component of the aerosol-forming matrix entering one end of the temperature reduction section and the at least one volatized component of the aerosol-forming matrix leaving the other end of the temperature reduction section. Therefore, the user can smoke the aerosol without feeling hot at the mouth, and the smoking experience of the user is improved.

Figure 2:
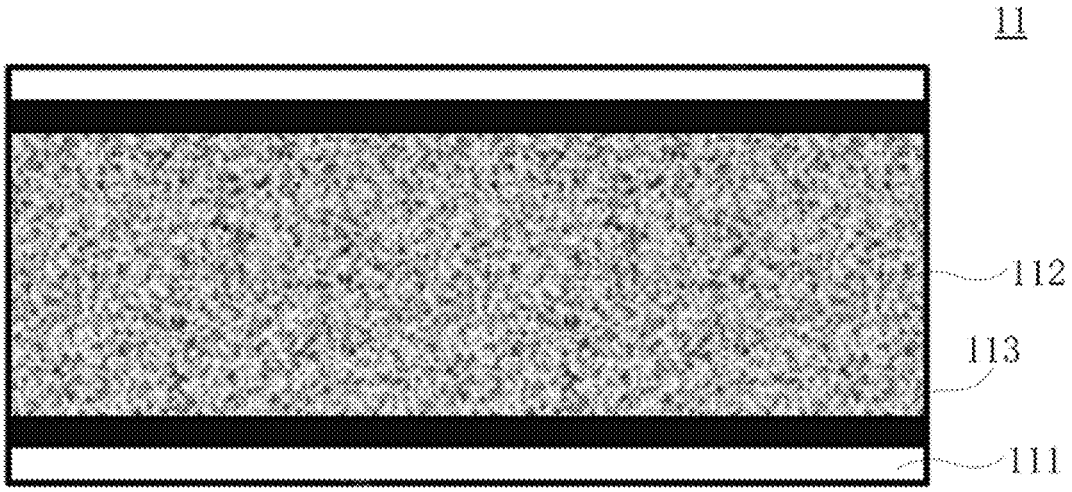
FIG. 2 is a schematic view of a smoke generating section in the smoking article provided according to the embodiment of the present application.

Referring to FIG. 2, the smoke generating section 11 has a tube wall 111 and a tube cavity 112. The tube cavity 112 is configured to contain the aerosol-forming matrix (shown by gray matter in the figure).

An infrared radiation layer 113 is formed on at least part of the inner surface of the tube wall 111; and the infrared radiation layer 113 is configured to be heated by the smoking set to generate infrared rays and at least heat the aerosol-forming matrix by radiation.

In this example, the infrared radiation layer 113 is a continuous film layer, which is formed on the inner surface of the tube wall 111 and covers the aerosol-forming matrix in the tube cavity 112. After the infrared radiation layer 113 absorbs the heat transmitted by the smoking set, the temperature of the infrared radiation layer 113 rises and the infrared radiation layer 113 can generate infrared rays with a certain wavelength.

The infrared radiation layer 113 may be made of oxides, carbon materials, carbides, nitrides and other materials with high infrared radiance. The materials are specifically as follows.

The metal oxides and multicomponent alloy oxides include: ferric oxide, aluminum oxide, chromium oxide, indium oxide, lanthanum oxide, cobaltic oxide, nickel oxide, antimony oxide, antimony pentoxide, titanium dioxide, zirconium dioxide, manganese dioxide, cerium dioxide, copper oxide, zinc oxide, magnesium oxide, calcium oxide, molybdenum trioxide or the like; or a combination of two or more metal oxides described above; or a ceramic material with a unit cell structure such as spinel, perovskite and olivine.

The emissivity of carbon materials is close to that of a blackbody, and the carbon materials have a higher infrared radiance. The carbon materials include: graphite, carbon fiber, carbon nanotubes, graphene, diamond-like carbon thin films or the like.

The carbides include: silicon carbide, which has high emissivity in a large infrared wavelength range (2.3 microns to 25 microns) and is a preferred near-full-band infrared radiation material; in addition, the carbides include tungsten carbide, iron carbide, vanadium carbide, titanium carbide, zirconium carbide, manganese carbide, chromium carbide, niobium carbide or the like, all of which have high infrared emissivity (MeC phase does not have strict stoichiometric composition and chemical formula).

The nitrides include metal nitrides and nonmetal nitrides, wherein the metal nitrides include titanium nitride, titanium carbonitride, aluminum nitride, magnesium nitride, tantalum nitride, vanadium nitride or the like, and the nonmetal nitrides include boron nitride, phosphorus nitride, silicon nitride ($Si_3N_4$) or the like.

Other inorganic nonmetallic materials include: silica, silicate (including phosphosilicate, borosilicate or the like), titanate, aluminate, phosphate, boride, chalcogenide or the like.

In this example, the thickness of the infrared radiation layer 113 is 100 nm to 3000 nm.

The preparation process of forming the infrared radiation layer 113 on the inner surface of the tube wall 111 will be described below with reference to the winding film coating equipment of FIG. 6.

Figure 6:
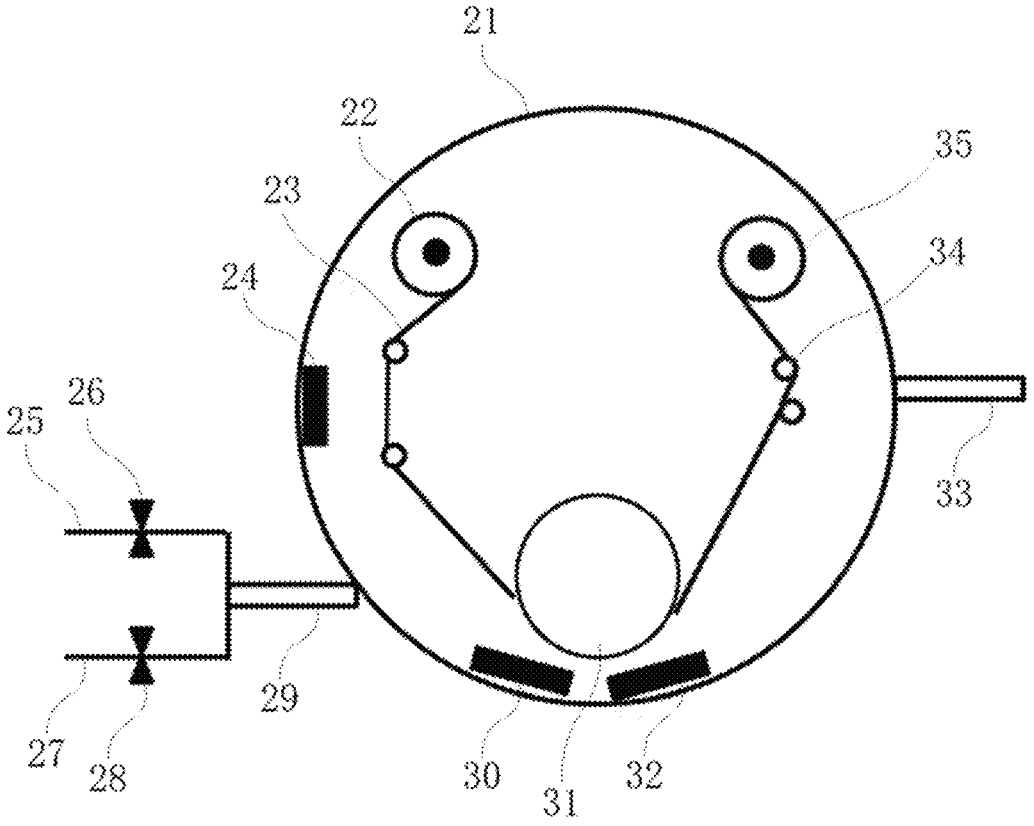
FIG. 6 is a schematic view of a winding film coating equipment provided according to an embodiment of the present application.

As shown in FIG. 6, the winding film coating equipment comprises a vacuum cavity 21, a film unreeling roll 22, a cigarette paper base film 23, an ion source 24, an air path 25, a flow valve 26, a gas path 27, a flow valve 28, an air inlet tube 29, a target material 30, a film coating roller 31, a target material 32, an air suction hole 33, a tension wheel 34, and a film collecting roll 35.

Winding film coating is a technology that applies different methods to realize continuous film coating on a flexible base in vacuum environment. The winding film coating technology has the following characteristics:

1. the deposition speed is fast, the temperature rise of the substrate is low, and it is suitable for flexible substrates and substrates with low melting points;
2. the ion source 24 is adopted for bombarding the substrate, and the prepared thin film has good binding force with the base;
3. the prepared thin film has high purity, good compactness and good film forming uniformity;
4. the repeatability of the preparation process is good, and a thin film with uniform thickness may be obtained on a large-area substrate, and the film thickness may be accurately controlled by adjusting the rotation speed of the film unreeling roll 22 and the film collecting roll 35 and the film coating process (target material power, process atmosphere, etc.);
5. different metals, alloys, oxides and nitrides can be mixed and sputtered on the substrate at the same time.

The infrared radiation coating 113 is deposited on the cigarette paper substrate, and then the cigarette equipped with the infrared radiation coating 113 is prepared by processes such as cutting, filling cut tobacco and bonding or the like. The infrared radiation layer 113 is titanium dioxide. Specifically, a titanium target is adopted, a bipolar pulsed DC magnetron sputtering power supply is used as the target power supply, and argon and an appropriate amount of oxygen are introduced as reaction gases to deposit a titanium dioxide thin film. The preparation process is as follows:

first, the coiled cigarette paper substrate is installed on the film unreeling roll 22; and one end of the film unreeling roll 22 is wound around the film collecting roll 35 along the film coating roller 31 and the tension wheel 34;

all the doors of the cavities are closed, and the cavities are evacuated to 5×10−4 Pa;

argon and oxygen are introduced to maintain a pressure of 0.1 Pa; wherein the ratio of argon to oxygen is maintained between 8:2 and 9:1;

the winding speed of the film collecting roll 35 is set to 4 m/min;

the (intermediate frequency) ion source power supply is turned on, and the power of the power supply is set to 800 W; the ion source can clean the surface of cigarette paper film by plasma to produce a fresh surface, thereby improving the binding force between the film and the base;

the bipolar pulsed DC magnetron sputtering power supply connected with the titanium target is turned on, the power of the power supply is set to 3000 W, the titanium target is sputtered with plasma, and reacted with oxygen to generate titanium dioxide which is deposited on the cigarette paper substrate;

through the above process, the deposited film thickness of titanium dioxide is about 400 nm, and the uniformity of film thickness is more than 90%; according to the hemispherical infrared radiation test, the infrared radiance is high (about 80% to 95%), which is much higher than that of cigarette paper (about 50% to 70%).

Figure 3:
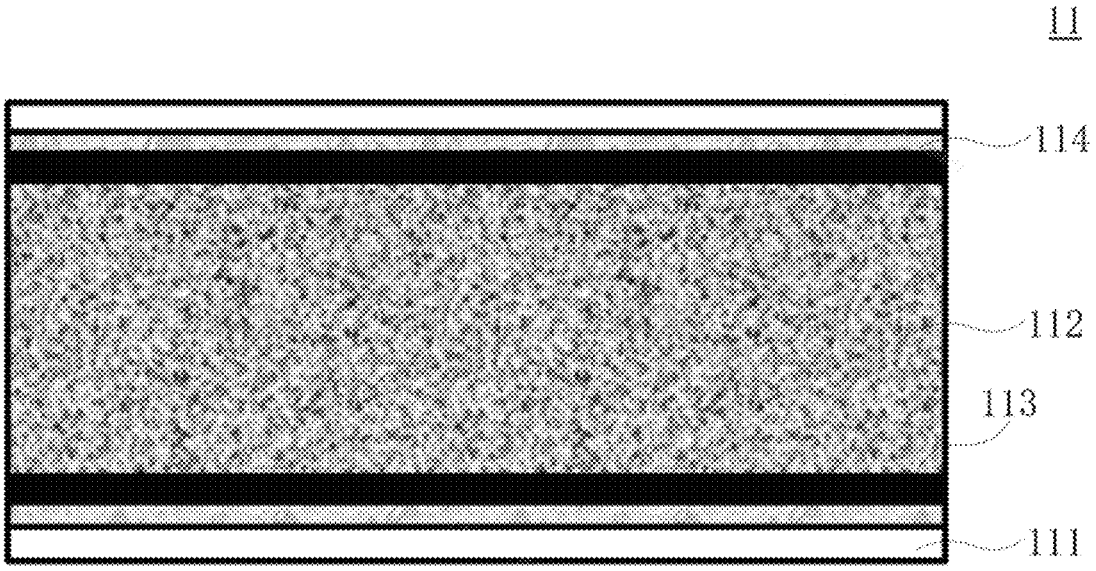
FIG. 3 is a schematic view of a smoke generating section with an infrared reflecting layer in the smoking article provided according to the embodiment of the present application.

Referring to FIG. 3, in an example, the smoking article 10 further comprises an infrared reflecting layer 114, and the infrared reflecting layer 114 is disposed between the infrared radiation layer 113 and the inner surface of the tube wall 111.

In terms of central heating mode, when the infrared radiation layer 113 absorbs the heat transmitted by the smoking set, the infrared rays generated may be transmitted to the outside of the smoking article 10 through the tube wall 111. The infrared reflecting layer 114 can prevent the infrared rays generated by the infrared radiation layer 113 from being transmitted to the outside of the smoking article 10 through the tube wall 111, thereby improving the heat utilization rate.

In this example, the infrared reflective layer 114 comprises at least one of metal, metal oxide and nitride. Specifically, the infrared reflective layer 114 may be made of one or more of gold, silver, nickel, aluminum, gold alloy, silver alloy, nickel alloy, aluminum alloy, gold oxide, silver oxide, nickel oxide and aluminum oxide, titanium oxide, zinc oxide and cerium dioxide.

Hereinafter, the preparation process of the infrared radiation layer 113 and the infrared reflecting layer 114 will be described still with reference to the winding film coating equipment of FIG. 6.

In the preparation process, double targets are adopted to finish film coating at one time. The infrared reflecting layer 114 is first deposited on the cigarette paper substrate, and then the infrared radiation layer 113 is deposited. In the cigarette manufacturing process, the film coated surface faces the cut tobacco, so that the infrared reflecting layer 114 is farther away from the cut tobacco than the infrared radiation layer 113. On the one hand, the heat inside the cut tobacco can be prevented from radiating outward through infrared rays; and on the other hand, the infrared radiation layer 113 provides better directional radiation of infrared rays, i.e., radiation into the cut tobacco. The preparation process is as follows:

first, the coiled cigarette paper substrate is installed on the film unreeling roll 22; and one end of the film unreeling roll 22 is wound around the film collecting roll 35 along the film coating roller 31 and the tension wheel 34;

all the doors of the cavities are closed, and the cavities are evacuated to 5×10−4 Pa;

argon is introduced, and argon flow is adjusted to maintain the pressure of the vacuum cavity at 0.1 Pa;

the winding speed of the film collecting roll 35 is set to 4 m/min;

the (intermediate frequency) ion source power supply is turned on, and the power of the power supply is set to 800 W; the ion source can clean the surface of cigarette paper film by plasma to produce a fresh surface, thereby improving the binding force between the film and the base;

the DC power connected with the aluminum target is turned on, the sputtering power of the power supply is set to 2500 W, the aluminum target is sputtered with argon plasma, and deposited on the cigarette paper substrate to form the infrared reflecting layer 114;

the RF magnetron sputtering power supply connected with the silicon carbide target is turned on, the power of the power supply is set to 3000 W, the silicon carbide target is sputtered with argon plasma, and the sputtered silicon carbide plasma is directly deposited on the cigarette paper substrate to form a silicon carbide film with high infrared radiance, i.e., the infrared radiation layer 113;

through the above process, the deposited thickness of the aluminum film is about 300 nm to 500 nm, the thickness of the silicon carbide film is about 300 nm to 550 nm, and the uniformity of film thickness is greater than 90%; the infrared reflectivity is over 95%, and the infrared radiance is over 92%.

For the cigarette paper made by the above process, the central heating mode is adopted to test the temperature of cut tobacco close to the cigarette paper. The time for the temperature to rise to 200 degrees is shortened by 5 seconds (from 20 seconds to 15 seconds) as compared to the cigarette made of uncoated cigarette paper. When the infrared circumferential heating mode is adopted to test the temperature of cut tobacco close to the cigarette paper, the time for the temperature to rise to 200 degrees is shortened by 5 seconds from 25 seconds to 20 seconds) as compared to the cigarette made of uncoated cigarette paper.

Figure 4:
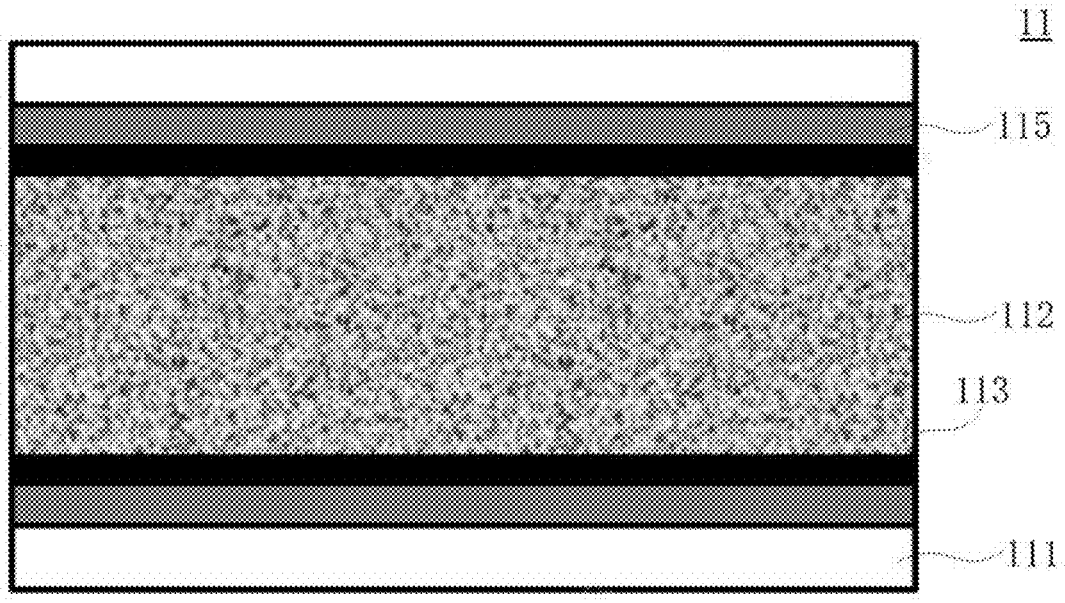
FIG. 4 is a schematic view of a smoke generating section with a flame retardant layer in the smoking article provided according to the embodiment of the present application.

Referring to FIG. 4, in one example, the smoking article 10 further comprises an infrared reflection flame retardant layer 115, and the infrared reflection flame retardant layer 115 is disposed between the infrared radiation layer 113 and the inner surface of the tube wall 111.

In this example, an aluminum foil or a tin foil may be selected as the infrared reflection flame retardant layer 115. The aluminum foil or the tin foil is smoothed, and then an infrared radiation layer 113 is deposited on the smoothed aluminum foil or tin foil. The smoothed aluminum foil or tin foil can reflect the infrared rays generated by the infrared radiation layer 113 to a certain extent, and at the same time has a certain flame retardant effect.

Reference may be made to the foregoing contents for the preparation process of the infrared radiation layer 113, and this will not be further described herein.

In an example, the infrared radiation layer 113 may be a discontinuous film layer. Specifically, the infrared radiation layer 113 may be a patterned infrared radiation layer.

Figure 5:
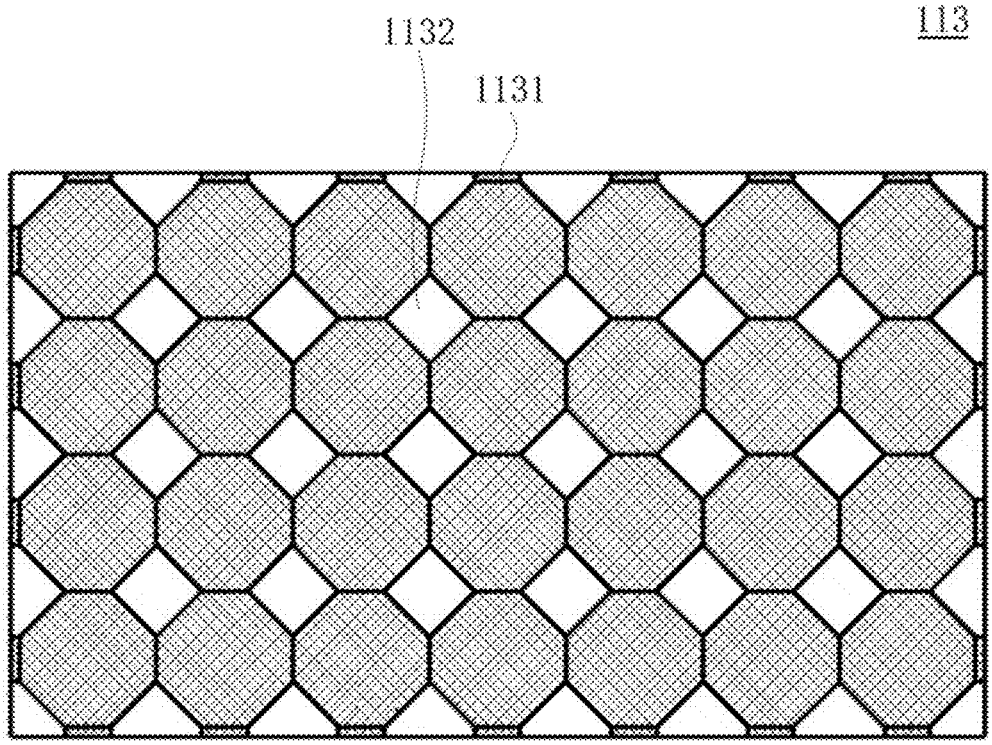
FIG. 5 is a schematic view of an infrared radiation layer in the smoking article provided according to the embodiment of the present application.

Referring to FIG. 5 for appreciation, the infrared radiation layer 113 is a grid-shaped infrared radiation layer, and the grid-shaped infrared radiation layer 113 comprises a plurality of infrared radiation blocks 1131 and a plurality of meshes 1132, and the meshes 1132 are enclosed by the partial peripheries of the plurality of infrared radiation blocks 1131, and the meshes 1132 are films with no infrared radiation function.

In the example of FIG. 5, the infrared radiation block 1131 has a shape of regular hexagon, and the mesh 1132 is a square enclosed by four sides of four infrared radiation blocks 1131 in the shape of regular hexagon. The area of the mesh 1132 is 30% to 80% of the infrared radiation layer 113.

For the infrared circumferential heating mode (in which the smoking set generates infrared rays and at least heats the aerosol-forming matrix by radiation), the infrared radiation block 1131 absorbs the infrared rays generated by the smoking set to a certain extent, which will correspondingly reduce the proportion of the infrared rays of corresponding wavebands penetrating through the tube wall 111 (at the same time, the tube wall 111 will absorb infrared rays to be heated up, and then radiate infrared rays towards the aerosol-forming matrix). In order to avoid this problem, the meshes 1132 are provided which will not block the infrared rays generated by the smoking set, and the infrared rays can penetrate into the interior of the smoking article 10. Relatively speaking, the heating efficiency of the smoking set for the smoking article 10 can be improved.

It shall be noted that the shapes of the infrared radiation blocks 1131 and the meshes 1132 are not limited to those shown in FIG. 5. In other examples, the shape of the infrared radiation blocks 1131 may be at least one of a polygon, a circle or an irregular figure; and the shape of the meshes 1132 is at least one of a polygon, a circle or an irregular figure.

It shall be noted that, the specification and attached drawings of the present application show preferred embodiments of the present application. However, the present application can be implemented in many different forms, and it is not limited to the embodiments described in this specification. These embodiments are not construed as additional restrictions on the content of the present application, but are provided for a more thorough and comprehensive understanding of the disclosure of the present application. In addition, the above technical features continue to be combined with each other to form various embodiments not listed above, all of which are regarded as within the scope described in the specification of the present application. Further speaking, those of ordinary skill in the art can make improvements or variations according to the above description, and all these improvements and variations shall fall within the scope claimed in the appended claims of the present application.

What is claimed is:

1. A smoking article, comprising an aerosol-forming matrix, being used in combination with a smoking set disposed outside the smoking article for heating to volatilize at least one component of the aerosol-forming matrix, the smoking article comprising:

a smoke generating section, having a tube wall and a tube cavity; the tube cavity being configured to contain the aerosol-forming matrix;

an infrared radiation layer, being formed on at least part of the inner surface of the tube wall; the infrared radiation layer being configured to be heated by the smoking set to generate infrared rays and at least heat the aerosol-forming matrix by radiation;

wherein the smoking article further comprises an infrared reflecting layer for reflecting the generated infrared rays from the infrared radiation layer back;

the infrared reflecting layer is arranged between the infrared radiation layer and the inner surface, and directly engages with the infrared radiation layer.

2. The smoking article according to claim 1, wherein the infrared radiation layer is a continuous film layer.

3. The smoking article according to claim 1, wherein the infrared reflecting layer comprises at least one of metal, metal oxide and nitride.

4. The smoking article according to claim 3, wherein the infrared reflecting layer is an infrared reflection flame retardant layer, and the infrared reflection flame retardant layer comprises an aluminum foil or a tin foil.

5. The smoking article according to claim 1, wherein the infrared radiation layer is a film layer with a plurality discontinuous meshes disposed on a layer surface of the infrared radiation layer, the plurality of meshes are films with no infrared radiation function.

6. The smoking article according to claim 5, wherein the infrared radiation layer is a patterned infrared radiation layer via evenly distributing the plurality of meshes on the layer surface of the infrared radiation layer.

7. The smoking article according to claim 1, wherein the thickness of the infrared radiation layer is 100 nm to 3000 nm.

8. The smoking article according to claim 1, wherein the infrared radiation layer comprises at least one of oxide, carbon material, carbide and nitride.

9. The smoking article according to claim 1, wherein the infrared radiation layer is formed on at least part of the inner surface of the tube wall by a winding film coating method.

10. The smoking article according to claim 5, wherein an area of the plurality of meshes is 30% to 80% of a total area of the layer surface of the infrared radiation layer.

11. The smoking article according to claim 5, wherein each of the plurality of meshes is enclosed via at least two infrared radiation blocks formed in the infrared radiation layer.

* * * * *